US005901389A

United States Patent [19]

Manner

[11] Patent Number: 5,901,389

[45] Date of Patent: May 11, 1999

[54] BED SHEET

[76] Inventor: Marianne Manner, 45763 Holmes, Canton, Mich. 48187

[21] Appl. No.: 08/912,075

[22] Filed: Aug. 15, 1997

[51] Int. Cl.[6] ..... A47G 9/00

[52] U.S. Cl. ..... 5/497; 5/482; 5/499

[58] Field of Search ..... 5/482, 497, 498, 5/499, 500

[56] References Cited

U.S. PATENT DOCUMENTS

| | | | |
|---|---|---|---|
| 3,090,052 | 5/1963 | Goldsmith | 5/482 X |
| 3,962,739 | 6/1976 | Crockett | 5/497 |
| 4,035,854 | 7/1977 | Pardee . | |
| 4,161,044 | 7/1979 | Bogle . | |
| 4,308,626 | 1/1982 | Weiss . | |
| 4,656,682 | 4/1987 | DeFelice et al. . | |
| 4,964,184 | 10/1990 | Lewis . | |
| 4,979,251 | 12/1990 | Lazar . | |
| 5,042,098 | 8/1991 | Stultz . | |
| 5,084,929 | 2/1992 | Staudinger . | |
| 5,099,531 | 3/1992 | Schmier . | |
| 5,557,814 | 9/1996 | Cybulski . | |

*Primary Examiner*—Brian K. Green
*Assistant Examiner*—Robert G. Santos
*Attorney, Agent, or Firm*—Howard & Howard

[57] ABSTRACT

An improved bed sheet including a bottom form-fitted sheet for covering a mattress and a top sheet joined to the bottom sheet. The sheets are joined together by joining bottom and side edges of the top sheet to respective bottom and side edges of the bottom sheet. Elastic bands are sewn into top and bottom edges of the bottom sheet for enabling the bottom sheet to remain secured to the mattress. The top sheet is wider than the bottom sheet and is positioned relative to the bottom sheet to overlap only one side edge of the bottom sheet.

7 Claims, 3 Drawing Sheets

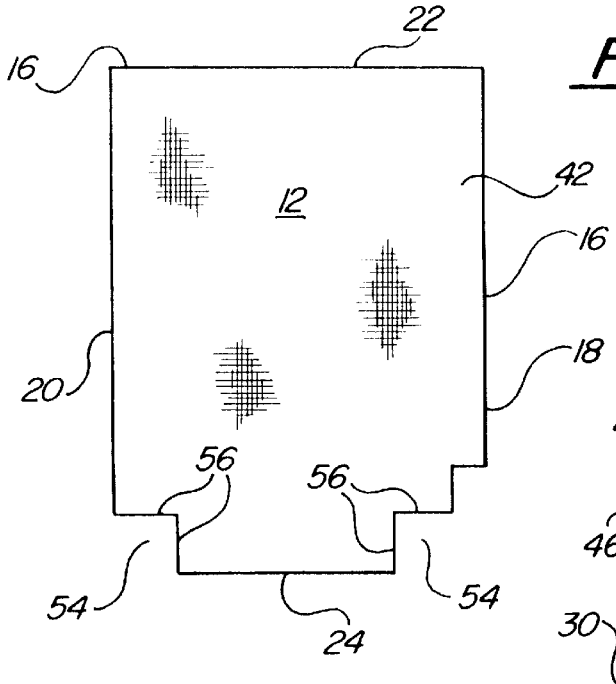
FIG-5
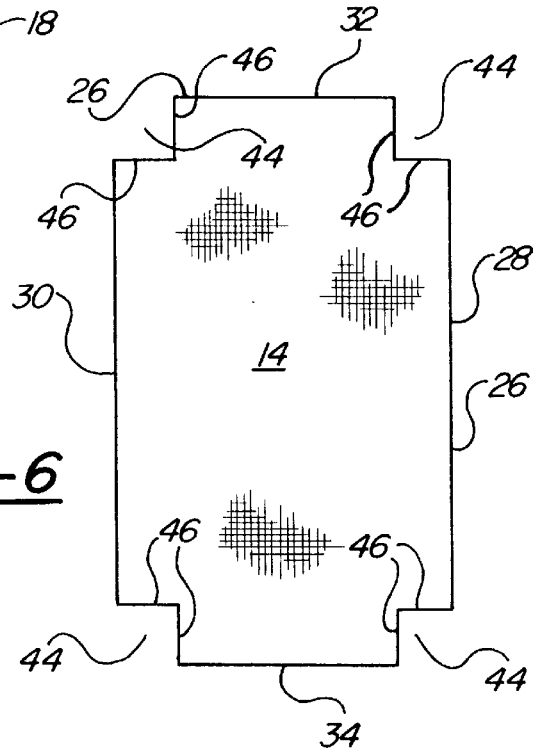
FIG-6
FIG-7
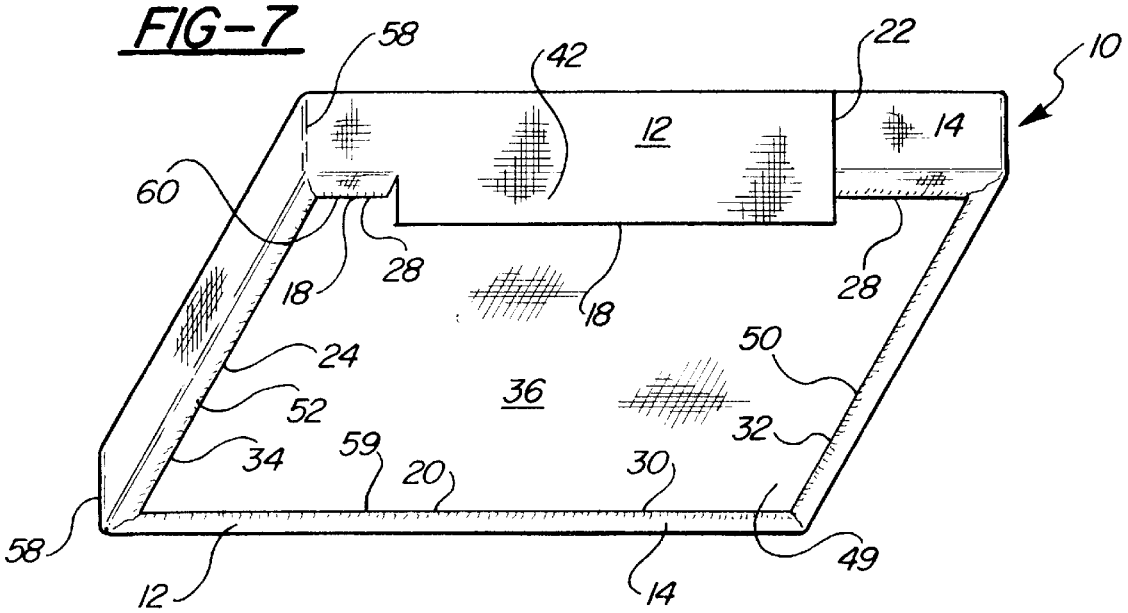

BED SHEET

TECHNICAL FIELD

The invention relates to an improved bed sheet for covering a mattress.

BACKGROUND ART

By way of background, standard bed sheets comprise a fitted sheet and a flat sheet. The fitted sheet is sewn together in such a matter to form a generally rectangular pocket for surrounding a mattress, while the flat sheet is a flat section of fabric which is separate from the fitted sheet. The fitted sheet has elastic bands sewn into top and bottom edges of the sheet to enable the fitted sheet to remain secured to the mattress. To secure the flat sheet to the mattress, the flat sheet must be partially tucked beneath a lower end of the mattress and along a small portion of both sides of the mattress. The flat sheet is wider than the fitted sheet and is typically centered with respect to the mattress such that the flat sheet will overlap the fitted sheet by an equal amount on both sides of the mattress.

When a bed is positioned against a wall of a bedroom, it is often inconvenient to place sheets on a mattress on the bed without moving the bed away from the wall. Although it is possible to place the fitted sheet on the mattress without moving the bed, the flat sheet cannot be easily tucked under the side of the mattress adjacent the wall without moving the bed. Further, because the flat sheet includes a portion which overlaps the fitted sheet adjacent the wall, this portion must be allowed to drape between the mattress and the wall making it difficult to properly place the flat sheet on the mattress without moving the bed. For heavier beds, such as bunk beds, moving the bed can be a difficult chore.

The prior art discloses various improvements to bed sheets to make the sheets easier to place on a mattress. For example, U.S. Pat. No. 4,035,854 to Pardee discloses a bed sheet including a fitted sheet for covering a mattress and a flat sheet joined to the fitted sheet along a bottom edge of the fitted sheet and along a small portion of each side edge of the fitted sheet adjacent the bottom edge. The flat sheet is wider than the fitted sheet and overlaps the fitted sheet by an equal amount on both sides of the mattress. By placing the fitted sheet on the mattress, the flat sheet will necessarily be secured to the mattress and will be automatically positioned with respect to the mattress.

U.S. Pat. No. 4,161,044 to Bogle also discloses a bed sheet including a flat sheet joined to a fitted sheet. The flat sheet is permanently joined to the fitted sheet along one side edge of the flat sheet. The opposing side edge and bottom edge of the flat sheet are secured to the fitted sheet by a zipper or other closure device. The flat sheet is joined to the fitted sheet adjacent the top surface of the mattress such that the flat sheet is tightly pinned to the mattress providing little room for a person to move beneath the flat sheet.

The prior art does not disclose a bed sheet adapted for use on a bed which is positioned against a wall. Specifically, the prior art does not disclose a bed sheet which can be easily installed on a mattress without moving the mattress away from a wall, which maintains the appearance of a standard bed sheet, and which is as comfortable to use as a standard bed sheet.

SUMMARY OF THE INVENTION

The present invention provides a mattress cover including a bottom sheet having an outer perimeter including a first side edge, a second side edge, a top edge and a bottom edge. A top sheet is also provided having an outer perimeter including a first side edge, a second side edge, a top edge and a bottom edge. The top and bottom sheets each include a length from the top edge to the bottom edge, and the sheets also each include a width from the first side edge to the second side edge. The bottom sheet includes a centerline extending lengthwise along said bottom sheet and dividing said bottom sheet into symmetrical sections, and the top sheet is wider than the bottom sheet along at least the portion of the length of the top sheet. The top sheet is joined to the bottom sheet such that the first side edge of the top sheet is spaced further from the centerline of the bottom sheet than the second side edge of the top sheet.

The present invention also provides a mattress cover including a bottom sheet having an outer perimeter having a first side edge, a second side edge, a top edge and a bottom edge. A top sheet is also provided including an outer perimeter having a first side edge, a second side edge, a top edge and a bottom edge. The top and bottom sheets each include a length from the top edge to the bottom edge, and the top and bottom sheets also each include a width from the first side edge to the second side edge. The bottom edges of the top and bottom sheets are joined together along at least a portion of the bottom edges, and the second side edges of the top and bottom sheets are joined together along over half of the length of the bottom sheet.

The present invention also provides a mattress cover including a bottom sheet having an outer perimeter including a first side edge, a second side edge, a top edge, and a bottom edge. A top sheet is also provided having an outer perimeter including a first side edge, a second side edge, a top edge and a bottom edge. The top and bottom sheets each include a length from the top edge to the bottom edge, and the top and bottom edge each include a width from the first side edge to the second side edge. The top sheet is wider than the bottom sheet along at least a portion of the length of the top sheet, and the top sheet is joined to the bottom sheet such that the first side edge of the top sheet overlaps the first side edge of the bottom sheet along at least a portion of the length of the top sheet and the second side edge of the top sheet does not overlap the second side edge of the bottom sheet.

By providing a mattress cover in which the top sheet overlaps the bottom sheet along only one side of the bottom sheet, the mattress cover is more readily adapted for use on a bed placed against a wall. Specifically, the top sheet can overlap the bottom sheet on the exposed side of the bed and have the appearance of a standard flat sheet. However, on the side of the bed adjacent the wall, the top sheet will not overlap the bottom sheet and will, therefore, not include additional material which must normally be placed between the bed and the wall. Further, by joining the top and bottom sheets along the bottom edges of the sheets and along a substantial portion of one of the side edges of the sheets, the sheets create a comfortable enclosure for a person while remaining securely joined together. Because the sheets are joined together, the top sheet will also be automatically secured to the mattress merely by placing the bottom sheet on the mattress, eliminating the need to move the bed in order to properly place the top sheet on the mattress.

DESCRIPTION OF THE DRAWINGS

FIG. 5 is a top view of the top sheet of the present invention prior to being joined with the bottom sheet;

FIG. 6 is a top view of the bottom sheet of the present invention prior to being joined with the top sheet; and FIG. 7 is a perspective view of the bottom surface and right side of a mattress with the bed sheet of the present invention disposed thereon.

DETAILED DESCRIPTION OF THE PREFERRED EMBODIMENT

Figure 1:
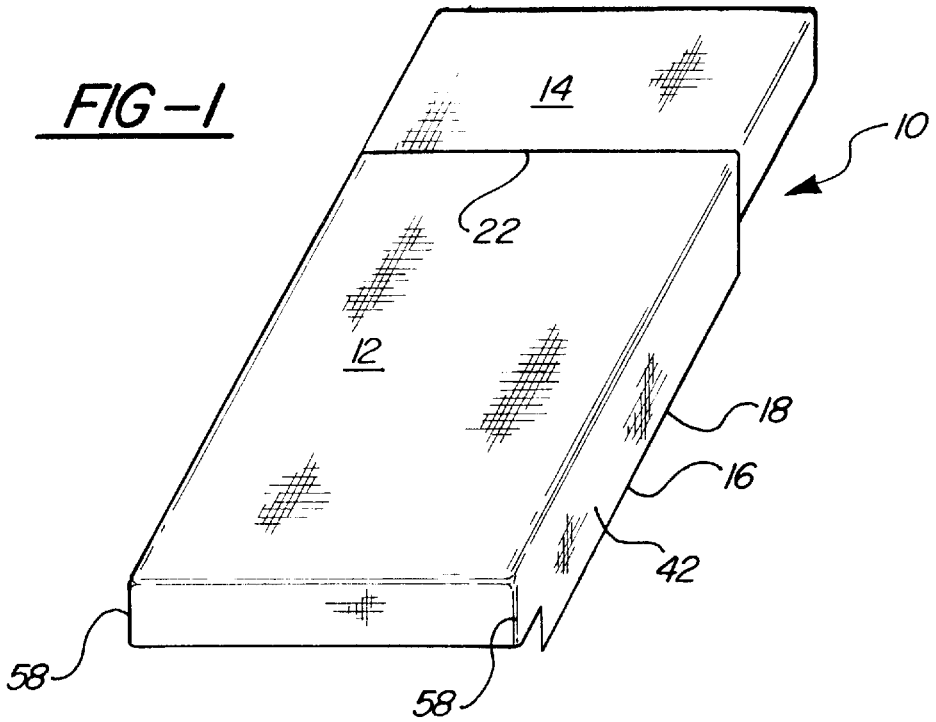
FIG. 1 is a perspective view of the top surface and right side of a mattress with the bed sheet of the present invention disposed thereon.
Figure 2:
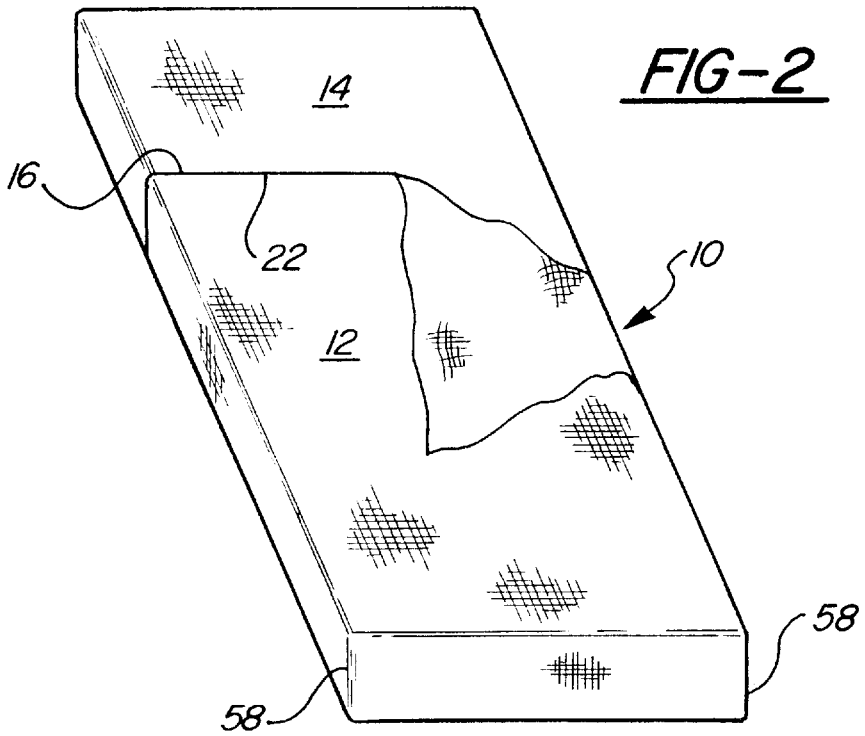
FIG. 2 is a perspective view of the top surface and left side of a mattress with the bed sheet of the present invention disposed thereon.

As shown in FIGS. 1 and 2, the present invention comprises a mattress cover 10 including a top sheet 12 and a bottom sheet 14. The top sheet 12 is commonly referred to as a flat sheet, and the bottom sheet 14 is commonly referred to as a fitted sheet. As shown in FIG. 5, the top sheet 12 includes an outer perimeter 16 including a first side edge 18, a second side edge 20, a top edge 22, and a bottom edge 24. Similarly, as shown in FIG. 6, the bottom sheet 14 includes an outer perimeter 26 including a first side edge 28, a second side edge 30, a top edge 32, and a bottom edge 34. The top and bottom sheets 12,14 each include a length measured from the respective top edges 22,32 to the bottom edges 24,34. The top and bottom sheets 12,14 also each include a width measured from the respective first side edges 18,28 to the second side edges 20,30.

Figure 3:
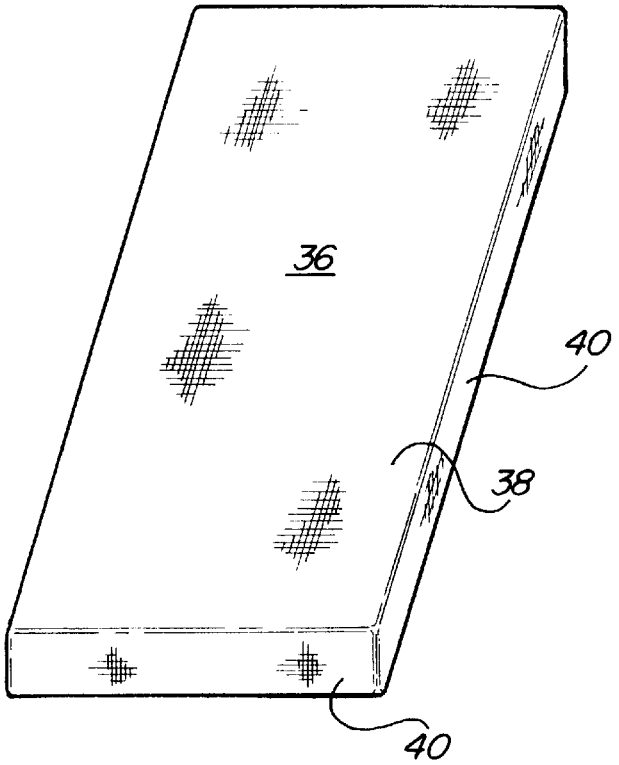
FIG. 3 is a perspective view of the top surface and right side of a mattress.
Figure 4:
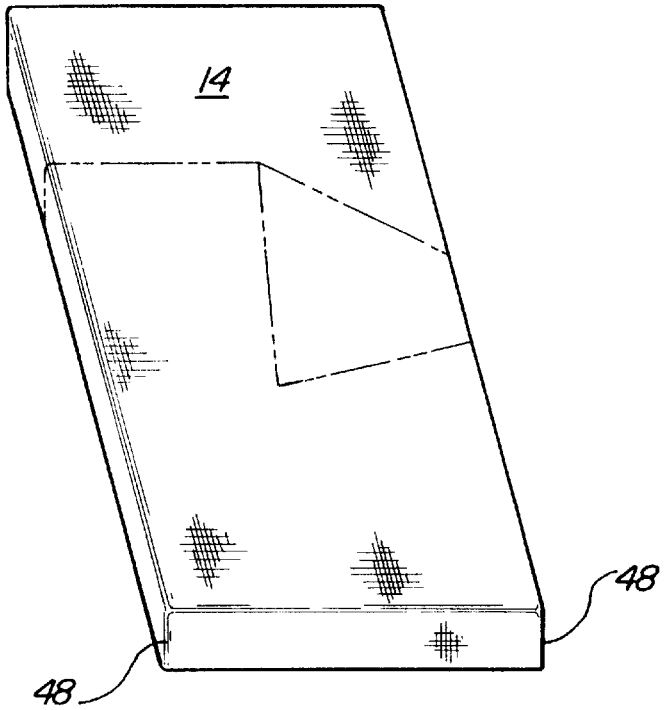
FIG. 4 is a perspective view of the bottom sheet of the present invention disposed on a mattress with the attached top sheet shown in phantom.

The mattress cover 10 is adapted to fit on a standard mattress 36, as shown in FIG. 3, which includes a top surface 38 and four sides 40. As shown in FIG. 4, the bottom sheet 14 defines a generally rectangular pocket which surrounds or embraces the mattress 36. As shown in FIG. 6, the bottom sheet 14 is initially a rectangular section of fabric including rectangular cut-out regions 44 adjacent each of the four corners of the bottom sheet 14. The cut-out regions 44 each include two adjacent edges 46; when the edges 46 are sewn together to form seams 48 as shown in FIG. 4, the bottom sheet 14 forms a pocket for surrounding the mattress 36. The length and width of the bottom sheet 14 are selected to permit the bottom sheet to fit snugly on the mattress 36 and cover the top surface 38 and sides 40 of the mattress 36.

As shown in FIG. 4, the seams 48 are positioned at each corner of the mattress 36 and extend vertically from a bottom surface 49 of the mattress 36 to the top surface 38. Similar to a typical fitted sheet, the bottom sheet 14 includes elastic bands 50,52 which are sewn into the top and bottom edges 32,34, respectively. The elastic band 52 in the bottom edge 34 extends along, and is sewn into, a portion of the first and second side edges 28,30 adjacent the bottom edge 34. Similarly, the elastic band 50 in the top edge 32 extends along, and is sewn into, a portion of the first and second side edges 28,30 adjacent the top edge 32. The length of the elastic bands 50,52 is selected such that the bands 50,52 will be elastically stretched when the bottom sheet 14 is placed on the mattress 36. Thus, the elastic bands 50,52 serve to maintain the bottom sheet 14 securely on the mattress 36.

As shown in FIG. 5, the top sheet 12 is also a rectangular member including rectangular cut-out regions 54 adjacent the two lower comers of the top sheet 12 at the bottom edge 24 of the top sheet 12. The cut-out regions 54 each include two adjacent edges 56 which can be sewn together to form seams 58 (shown in FIG. 7) in similar fashion to the bottom sheet 14.

As illustrated in FIG. 7, the bottom edges 24,34 of the top and bottom sheets 12,14, along with the elastic band 52, are sewn together to join the top and bottom sheets 12,14 together. The second side edges 20,30 are also sewn together to more completely secure the top sheet 12 to the bottom sheet 14 and create an enclosure between the top and bottom sheets 12,14. The second side edges 20,30 are sewn together along more than half of the length of the bottom sheet 14 along a seam 59 extending upwardly from the bottom edges 24,34. The top and bottom sheets 12,14 are also necessarily joined with the portion of the elastic band 52 extending along the second side edge 30 of the bottom sheet 14. Although sewing the top and bottom sheets 12,14 together joins them in a relatively permanent manner, releasable attachment means could also be utilized to join the top and bottom sheets 12,14 together such as hook and loop retainers (sold under the trade name Velcro).

A small portion of the first side edges 18,28 of the top and bottom sheets 12,14 adjacent the bottom edges 24,34 is also joined together. Specifically, the first side edges 18,28 are sewn together along a seam 60 at least as far as the elastic band 52 extends along the first side edge 28 of the bottom sheet 14. The first side edges 18,28 are not joined along more than half the length of the bottom sheet 14, however, so that a person may enter between the top and bottom sheets 12,14. In any event, regardless of the specific length of the seams 59,60, the seam 59 along the second side edges 20,30 of the top and bottoms sheets 12,14 will be longer than the seam 60 along the first side edges 18,28.

To avoid restricting the space between the top and bottom sheets 12,14, the seams 48,58 at the lower corners of the top and bottom sheets 12,14 are not joined together. If the seams 48,58 were joined together, the top sheet 12 would be pinned to the top surface 38 of the mattress 36, restricting the available foot-room for a person resting on the mattress 36 between the top and bottom sheets 12,14.

As shown in FIGS. 1, 2, and 7, the top sheet 12 is wider than the bottom sheet 14 and is joined to the bottom sheet 14 such that the top sheet 12 overlaps only the first side edge 28 of the bottom sheet without overlapping the second side edge 30 of the bottom sheet 14. In the preferred embodiment, the second side edges 20,30 of the top and bottom sheets 12,14 remain substantially aligned when the mattress cover 10 is positioned on a mattress 36. Said another way, the top sheet 12 defines a panel 42 which overlaps the first side edge 28 of the bottom sheet 14 and has a width equal to the difference in width between the top and bottom sheets 12,14.

The width of the panel 42 is constant in the embodiment shown in FIGS. 1 and 2. However, the top sheet 12 can also be designed such that the width of the panel 42 will vary along the length of the top sheet 12. If so, the panel 42 will have a portion of constant width adjacent the top edge 22 which will either gradually taper or abruptly reduce to a smaller width adjacent the bottom edge 24.

The mattress cover 10 is adapted for use on a bed which is positioned adjacent a wall. In the embodiment shown in FIGS. 1, 2, and 7, the mattress cover 10 is adapted for use on a bed in which the left side of the bed is positioned against a wall. Thus, the second side edges 20,30 of the top and bottom sheets 12,14 correspond to the left side edges of the sheets 12,14 and the overlapping panel 42 on the top sheet 12 is positioned on the right side of the top sheet 12. However, the mattress cover 10 of the present invention can obviously be used on a bed in which the right side is positioned against a wall by merely reversing the features shown on the left side of the mattress cover 10 with those shown on the right side of the mattress cover 10.

The mattress cover 10 allows the top and bottom sheets 12,14 to be placed on the mattress 36 without requiring that the bed be moved away from the wall. The fact that the top and bottom sheets 12,14 are joined along a significant portion of the left side edges 20,30 eliminates the need to tuck the left side edge 20 of the top sheet 12 underneath the mattress 36 to secure the top sheet 12 to the mattress 36. Instead, when the bottom sheet 14 is placed on the mattress 36, the top sheet 12 will be automatically secured to the mattress and positioned appropriately. Further, because the left side edge 20 of the top sheet 12 does not overlap the left side edge 30 of the bottom sheet 14, the top sheet 12 does not include a portion which must drape between the mattress 36 and the wall. The overlapping panel 42 on the right side edge 18 of the top sheet 12 will, however, give the top sheet 12 the appearance of a standard flat sheet.

The mattress cover 10 can be made by modifying standard flat and fitted bed sheets. A standard flat sheet comprises essentially a rectangle of fabric, and a standard fitted sheet is generally the same as the bottom sheet 14 of the present invention. The first step is to remove the elastic band 52 from the bottom edge 34 of the fitted sheet 14. Next, the flat sheet is modified to form the shape of the top sheet 12 shown in FIG. 3 by removing the cut-out regions 54 and trimming the sheet 12 to define the panel 42 in the desired shape. The side edges 56 of the cut out regions 54 are next joined along seams 58, and then the bottom edges 24,34 of the top and bottom sheets, along with the elastic band 52, are sewn together. As the bottom edges 24,34 are being sewn together, the first side edges 18,28 and second side edges 20,30 are also sewn together a desired amount as discussed above.

Although the description of this invention has been given with reference to a particular embodiment, it is not to be construed in a limiting sense. Many variations and modifications will no doubt occur to those skilled in the art. For a definition of the invention, reference is made to the appended claims.

What is claimed is:

1. A mattress cover adapted for use on a bed positioned against a wall, said mattress cover including:

a bottom sheet including an outer perimeter including a first side edge, a second side edge, a top edge, and a bottom edge;

a top sheet including an outer perimeter including a first side edge, a second side edge, a top edge, and a bottom edge;

said top and said bottom sheets each including a length from said top edge to said bottom edge;

said bottom edges of said top and said bottom sheets being joined together along at least a portion of said bottom edges;

said top sheet being wider than said bottom sheet along at least a portion of said length of said top sheet;

said top sheet being joined to said bottom sheet such that said first side edge of said top sheet overlaps said first side edge of said bottom sheet by an amount substantially equal to the difference in width between said top and said bottom sheets and said second side edge of said top sheet is substantially aligned with said second side edge of said bottom sheet; and said second side edges of said top and said bottom sheets being joined together along over half of said length of said bottom sheet whereby said mattress cover is suited for use on a bed positioned against a wall because said top sheet is automatically installed on the mattress when said bottom sheet is secured to the mattress, and said second side edge of said top sheet requires little or no manual tucking either underneath the mattress or between the mattress and the wall.

2. The mattress cover of claim 1 wherein:

said first side edges of said top and said bottom sheets are joined together along less than half of said length of said bottom sheet.

3. A The mattress cover of claim 1 wherein:

said bottom sheet includes an elastic band joined to said bottom edge, said first side edge, and said second side edge of said bottom sheet; and said elastic band extends extending along the entirety of said bottom edge of said bottom sheet and along portions of said first and second side edges adjacent to said bottom edge of said bottom sheet.

4. The mattress cover of claim 3 wherein said bottom edge of said top sheet, said bottom edge of said bottom sheet, and said elastic band are joined together along the entirety of said bottom edge of said bottom sheet.

5. A mattress cover adapted for use on a bed positioned against a wall, said mattress cover including:

a bottom sheet having an outer perimeter including a first side edge, a second side edge, a top edge, and a bottom edge;

a top sheet having an outer perimeter including a first side edge, a second side edge, a top edge, and a bottom edge;

said bottom sheet including an elastic band attached thereto which is adapted to secure said bottom sheet to the mattress;

said top edges of said top and said bottom sheets being unattached to each other;

said bottom edges of said top and said bottom sheets being at least partially joined together;

said second side edges of said top and said bottom sheets being at least partially joined together along over half said length of said bottom sheet;

said top sheet being wider than said bottom sheet along at least a portion of said length of said top sheet; and said top sheet being joined to said bottom sheet such that said first side edge of said top sheet overlaps said first side edge of said bottom sheet by an amount substantially equal to the difference in width between said top and said bottom sheets and said second side edge of said top sheet is aligned with said second side edge of said bottom sheet;

whereby said mattress cover is suited for use on a bed positioned against a wall because said top sheet is automatically installed on the mattress when said bottom sheet is secured to the mattress, said overlapping first side edge gives said top sheet the appearance of a standard top sheet, and said second side edge of said top sheet requires little or no manual tucking either underneath the mattress or between the mattress and the wall.

6. The mattress cover of claim 5 wherein:

said elastic band is joined to said bottom edge, said first side edge, and said second side edge of said bottom sheet; and said elastic band extends along the entirety of said bottom edge of said bottom sheet and along portions of said first and second side edges adjacent to said bottom edge of said bottom sheet.

7. The mattress cover of claim 5 wherein said first side edges of said top and said bottom sheets are joined together along less than half of said length of said bottom sheet.

* * * * *